US005594955A

United States Patent [19]

Sommers

[11] Patent Number: 5,594,955

[45] Date of Patent: Jan. 21, 1997

[54] SURGICAL GOWN SLEEVE

[75] Inventor: Jay R. Sommers, Marietta, Ga.

[73] Assignee: Kimberly-Clark Corporation, Neenah, Wis.

[21] Appl. No.: 353,856

[22] Filed: Dec. 12, 1994

[51] Int. Cl.[6] ..... A41B 7/00; A41D 13/12

[52] U.S. Cl. ..... 2/114; 2/51; 2/123; 2/901

[58] Field of Search ..... 2/123, 125, 60, 2/114, 82, 272, 59, 901, 87, 51, 16, 2, 97; 428/246, 907, 253, 95, 297, 230, 236, 152, 157; 604/378, 304, 381, 382; 602/58

[56] References Cited

U.S. PATENT DOCUMENTS

| | | | |
|---|---|---|---|
| 2,668,294 | 2/1954 | Gilpin | 2/114 |
| 3,045,815 | 7/1962 | Abildgaard | 206/63.2 |
| 3,727,239 | 4/1973 | Thompson | 2/123 |
| 3,868,728 | 3/1975 | Krzewinski | 2/114 |
| 4,041,203 | 8/1977 | Brock et al. | 428/157 |
| 4,114,200 | 9/1978 | Smith et al. | 2/51 |
| 4,214,320 | 7/1980 | Belkin | 2/114 |
| 4,389,734 | 6/1983 | Franz et al. | 2/114 |
| 4,504,978 | 3/1985 | Gregory et al. | 2/59 |
| 4,586,196 | 5/1986 | White | 2/114 |
| 4,720,415 | 1/1988 | Vander Wielen et al. | 428/152 |
| 4,736,467 | 4/1988 | Schwarze et al. | 2/114 |
| 4,868,928 | 9/1989 | Norvell | 2/272 |
| 4,932,078 | 6/1990 | Jones et al. | 2/70 |
| 4,943,475 | 7/1990 | Baker et al. | 428/246 |
| 4,965,122 | 10/1990 | Morman | 428/225 |
| 4,981,747 | 1/1991 | Morman | 428/198 |
| 4,991,232 | 2/1991 | Taylor | 2/51 |
| 4,996,722 | 3/1991 | Jimenez et al. | 2/51 |
| 5,001,785 | 3/1991 | Heiman et al. | 2/51 |
| 5,025,501 | 6/1991 | Dillon | 2/51 |
| 5,064,703 | 11/1991 | Frankosky et al. | 2/87 |
| 5,138,717 | 8/1992 | Tolton | 2/82 |
| 5,155,867 | 10/1992 | Norvell | 2/114 |
| 5,226,992 | 7/1993 | Morman | 156/62.4 |
| 5,320,891 | 6/1994 | Levy et al. | 428/108 |
| 5,335,372 | 8/1994 | Wiedner et al. | 2/125 |
| 5,336,545 | 8/1994 | Morman | 428/152 |
| 5,461,724 | 10/1995 | Wiedner et al. | 2/114 |

FOREIGN PATENT DOCUMENTS

| | | |
|---|---|---|
| 3066366 | 3/1991 | Japan . |

*Primary Examiner*—Amy B. Vanatta
*Attorney, Agent, or Firm*—David J. Alexander

[57] ABSTRACT

A garment, such as a surgical gown, having a liquid impervious sleeve and a liquid retentive/impervious cuff is provided. The sleeve may be formed from a fibrous web secured to a liquid impervious film. The cuff may be formed from a liquid retentive layer and a liquid impervious layer. The cuff may be made elastic by securing an elastic layer between the liquid retentive layer and the liquid impervious layer. In another embodiment, the cuff may include inner and outer liquid retentive layers, wherein the liquid impervious layer and the elastic layer are captured therebetween.

28 Claims, 3 Drawing Sheets

SURGICAL GOWN SLEEVE

FIELD OF THE INVENTION

This invention relates to gowns and other garments and particularly to surgical gown sleeves. More particularly, this invention relates to an improved sleeve and cuff combination.

BACKGROUND OF THE INVENTION

As is generally known, sterile surgical gowns are designed to greatly reduce, if not prevent, the transmission through the gown of liquids and biological contaminates which may become entrained therein. In surgical procedure environments, such liquid sources include the gown wearer's perspiration, patient liquids such as blood, salvia, perspiration and life support liquids such as plasma and saline.

Many surgical gowns were originally made of cotton or linen and were sterilized prior to their use in the operating room. These gowns, however, permitted transmission or "strike-through" of many of the liquids encountered in surgical procedures. These gowns were undesirable, if not unsatisfactory, because such "strike through" established a direct path for transmission of bacteria and other contaminates to and from the wearer of the gown. Furthermore, the gowns were costly, and, of course, laundering and sterilization procedures were required before reuse.

Disposable surgical gowns have largely replaced linen surgical gowns. Because many surgical procedures require generally a high degree of liquid repellency to prevent strike-through, disposable gowns for use under these conditions are, for the most part, made entirely from liquid repellent fabrics.

In some surgical procedures where the risk of insult to the surgical gown is low, surgical gowns having cuffs formed from liquid pervious or liquid absorbent fabrics may provide adequate protection for the wearer. However, in other surgical procedures where the risk of insult to the surgical gown is high, additional protection may be required. In some instances, to provide additional protection a glove is worn which is of sufficient size to overlap the cuff and a portion of the sleeve.

However, when the sleeve cuff is formed from liquid retentive fabrics and is over-gloved by a surgical glove, perspiration may collect in the cuff. As the amount of perspiration retained in the cuff increases, the perspiration may migrate to the cuff/glove interface. Furthermore, the wearer's hand and arm movement may cause the retained perspiration to migrate beyond the cuff and into the portion of the sleeve adjacent the cuff. Strike-through may then occur when a liquid generated during the surgical procedure contacts the portion of the sleeve occupied by the migrated perspiration.

Additionally, in instances where the wearer's perspiration has not migrated beyond the glove but has saturated or soaked the cuff material, there still remains the risk of the wearer being contacted by a liquid generated during the surgical procedure. This is so because, such a liquid on the outer surface of the gown sleeve may travel down the sleeve and contact the perspiration laden cuff before or during the removal of the glove and or gown.

In other instances, surgical gowns used in high insult surgical procedures may also be provided with cuffs formed from liquid repellent materials. However, liquids, generated during surgery which by-pass the glove and reside on the gown sleeve may contact the wearer during removal of the gown and or glove.

Therefore, there exists a need for surgical gowns and particularly surgical gown sleeves which provide improved barrier protection and particularly improved barrier protection for the wearer's wrist while at the same time avoiding the problems associated with conventional sleeve and cuff designs.

SUMMARY OF THE INVENTION

In response to the above problems encountered by those skilled in the art, the present invention provides a garment, such as a surgical gown, which includes a liquid impervious sleeve and a liquid retentive and liquid impervious cuff. The impervious sleeve includes at least one layer of liquid impervious material such as a liquid impervious film. The cuff includes at least one liquid retentive layer and one liquid impervious layer. In one embodiment, the cuff may be made elastic by securing a plurality of elastic yarns between the liquid impervious film and the liquid retentive layer.

In another embodiment, the present invention provides a liquid impervious sleeve and a cuff having three layers in the order of liquid retentive//impervious//retentive. In this embodiment, the cuff includes at least one liquid impervious layer captured between a pair of liquid retentive layers. The cuff may be made elastic by securing a plurality of elastic yarns between the liquid impervious layer and at least one of the liquid retentive layers.

DETAILED DESCRIPTION OF THE INVENTION

Several terms may be used to describe affixing the various layers of the present invention together or to affixing the sleeve and the cuff described herein together. These terms include "join", "secure", "attach" and derivatives and synonyms thereof. Such affixing may be accomplished by any of several conventional methods. By way of example and not limitation, these methods include stitching, gluing, heat sealing, zipping, snapping, sonic or thermal bonding or using a hook and loop fastening system and other methods familiar to those skilled in the art. Adhesives suitable for securing the various layers of the present invention together include construction adhesives and pressure sensitive hot-melt adhesives such as Findly H2096 or H2088. Findly adhesives are available from Findly Adhesive Inc. of Wauwatosa, Wis.

The term "outer" or "outside" describes that surface of the garment which faces away from the wearer when the garment is being worn; "inner" or "inside" refers to the surface of the garment, or part thereof which faces either the clothes or body of the wearer.

The term "fabric" is used broadly herein to mean any planer textile structure produced by interlacing yarns, fibers or filaments. Thus, the fabric can be a woven or nonwoven web, either of which are readily prepared by methods well-known to those having ordinary skill in the art. For example, nonwoven webs are prepared by such processes as meltblowing, coforming, spunbonding, carding, air laying, and wet laying. Moreover, the fabric can consist of a single layer or multiple layers. In addition, a multilayered fabric can include films, scrim, and other non-fibrous materials.

Figure 1:
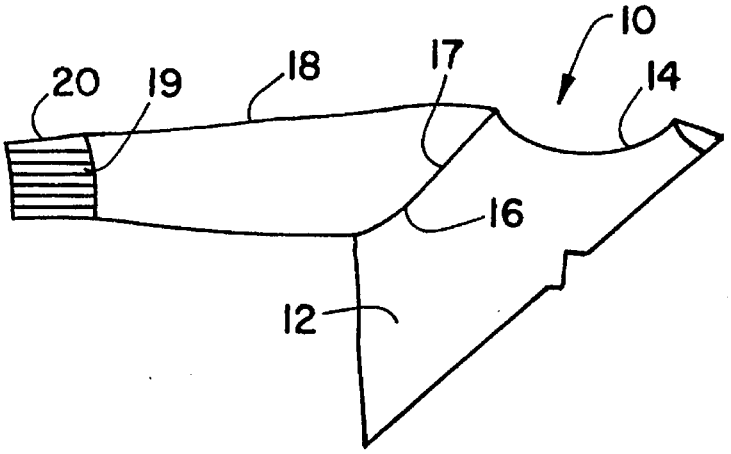
FIG. 1 is a fragmentary plan view of a surgical gown illustrating a sleeve and a cuff.

Turning now to the drawings and with reference to FIG. 1, a portion of a surgical gown 10 is illustrated. The surgical gown includes a body 12, portions of which define a neck opening 14 and a sleeve opening 16. A sleeve 18 is secured to the body 12 about the sleeve opening 16. The sleeve 18 includes a cuff 20 which is secured to the sleeve 18 about a wrist opening 19.

Figure 2:
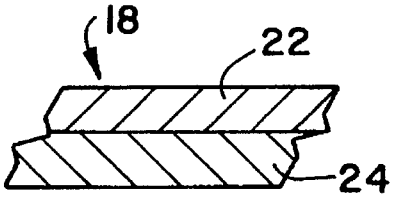
FIG. 2 is a schematic cross-sectional view of a portion of a laminate material useful in forming the sleeve.

Referring now to FIG. 2, the sleeve 18 may be formed from a liquid impervious layer 22 and a layer 24. In one embodiment, the liquid impervious layer 22 forms the outer layer of the sleeve 18 and the layer 24 forms the inner layer of the sleeve 18. The layer 24 may be formed from either a film or a fabric. The film or fabric forming the layer 24 may be either liquid impervious or liquid pervious.

The liquid impervious layer 22 may be a film formed from any suitable liquid impervious film forming material which is securable to the layer 24. Materials suitable for forming the liquid impervious layer 22 include, for example, polyethylene, polyurethane, ethylene, vinylacetate, ethylene methacrylate, and co-polyester films. An example of a co-polyester film suitable for forming the liquid impervious layer 22 is HYTREL®, a product of E. I. DuPont of Wilmington, Del. The thickness of the liquid impervious layer 22 may range from between about 0.5 mils to about 2.0 mils, and particularly from between about 0.75 mils to about 1.75 mils, and more particularly, from between about 0.9 mils to about 1.2 mils.

The layer 24 may be formed from a polymeric material. As used herein, the term "polymeric material" means a synthetic or natural polymeric material. As used herein, the term "polymeric fabric" means a fabric prepared from any polymeric material capable of being formed into a fabric.

By way of illustration only, examples of natural polymeric materials include, cotton, silk, wool, and cellulose. Synthetic polymeric materials, in turn, can be either thermosetting or thermoplastic materials, with thermoplastic materials being more common. Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as cross-linked epichlorohydrin-bisphenol A resins; phenolic resins, such as phenol-formaldehyde resins, including Novolacs and resols; and thermosetting polyesters, silicones, and urethanes.

Examples of thermoplastic polymers include, by way of illustration only, end-capped polyacetals, such as poly(oxymethylene) or polyformaldehyde, poly(trichloroacetaidehyde), poly(n-valeraldehyde), poly(acetaldehyde), poly(propionaldehyde), and the like; acrylic polymers, such as polyacrylamide, poly(acrylic acid), poly(methacrylic acid), poly(ethyl acrylate), poly(methyl methacrylate), and the like; fluorocarbon polymers, such as poly(tetrafluoroethylene), perfluorinated ethylene-propylene copolymers, ethylene-tetrafluoroethylene copolymers, poly(chlorotrifluoroethylene), ethylene-chlorotrifluoroethylene copolymers, poly(vinylidene fluoride), poly(vinyl fluoride), and the like; polyamides, such as poly(6-aminocaproic acid) or poly(ε-caprolactam), poly(hexamethylene adipamide), poly(hexamethylene sebacamide), poly(11-aminoundecanoic acid), and the like; polyaramides, such as poly(imino-1,3-phenyleneiminoisophthaloyl) or poly(m-phenylene isophthalamide), and the like; parylenes, such as poly-p-xylylene, poly(chloro-p-xylylene), and the like; polyaryl ethers, such as poly(oxy-2,6-dimethyl-1,4-phenylene) or poly(p-phenylene oxide), and the like; polyaryl sulfones, such as poly(oxy-1,4-phenylenesulfonyl-1,4-phenyleneoxy-1,4-phenylene-isopropylidene-1,4-phenylene), poly(sulfonyl-1,4-phenyleneoxy-1,4-phenylenesulfonyl-4,4'-biphenylene), and the like; polycarbonates, such as poly(bisphenol A) or poly(carbonyldioxy-1,4-phenyleneisopropylidene-1,4-phenylene), and the like; polyesters, such as poly(ethylene terephthalate), poly(tetramethylene terephthalate), poly(cyclohexylene-1,4-dimethylene terephthalate) or poly(oxymethylene-1,4-cyclohexylenemethyleneoxyterephthaloyl), and the like; polyaryl sulfides, such as poly(p-phenylene sulfide) or poly(thio-1,4-phenylene), and the like; polyimides, such as poly(pyromellitimido-1,4-phenylene), and the like; polyolefins, such as polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly(vinylidene chloride), polystyrene, and the like; copolymers of the foregoing, such as acrylonitrile-butadiene-styrene (ABS) copolymers, and the like.

In certain embodiments, when the layer 24 is formed from a polymer fabric, the polymeric fabric may be prepared from a polyolefin, such as, for example, polypropylene. A material well-suited for use as the layer 24 is a three-layer nonwoven polypropylene fabric known as SMS. SMS is an acronym for Spunbond, Meltblown, Spunbond, the process by which the three layers are constructed and then laminated together. See for example, U.S. Pat. No. 4,041,203 to Brock et al which is herein incorporated by reference.

Other non-limiting examples of fabrics suitable for use as the layer 24 include polyester knit, bonded carded polyolefin fiber web, necked-bonded or necked-stretched polyolefin fiber spunbond web, spunbond polyolefin web, meltblown polyolefin web, spunlaced polyolefin web or nylon tricot flat knits. Generally, the process for manufacturing necked-stretched spunbond is described in the following U.S. Pat. Nos.: 5,336,545; 5,226,992; 4,981,747; 4,965,122; and 5,320,891 which are all herein incorporated by reference.

Figure 3:
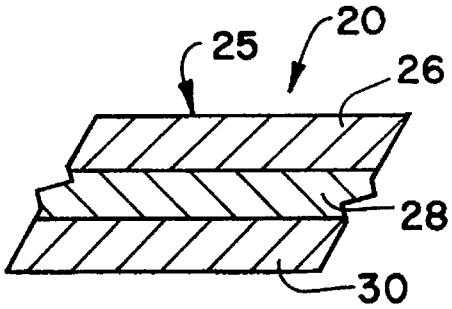
FIG. 3 is a schematic cross-sectional view of a portion of a laminate useful in forming the cuff.

Referring now to FIG. 3, the cuff 20 may be formed from a laminate 25 having a liquid retentive layer 26, an intermediate liquid impervious layer 28 and another liquid retentive layer 30. The intermediate liquid impervious layer 28 may be formed from any material suitable for forming the liquid impervious layer 22. As such, a liquid and particularly an aqueous liquid or a portion thereof, such as blood, saline, perspiration, etc., which comes in contact with the liquid retentive layers, 26 or 30, is retained therein. However, the movement of such liquid between the liquid retentive layers, 26 and 30, is prevented by the presence of the liquid impervious layer 28. In this way, liquid movement along the length of the sleeve 18 is impeded by contact and retention of the liquid or a portion thereof by the respective liquid retentive layer, 26 or 30. At the same time, liquid migration or strike-through between the liquid retentive layers, 26 and 30 of the cuff 20 is prevented by the presence of the liquid impervious layer 28 therebetween.

The liquid retentive layers, 26 and 30, respectively, may be formed from any polymeric material described above which is liquid wettable or which, by the inclusion of a suitable internal or external wetting agent, may be made liquid wettable, and particularly aqueous liquid wettable. Polymeric materials which are well suited for use in forming the liquid retentive layers, 26 and 30, include polyolefins, rayon, hydroentangled rayon or cotton, rayon bonded carded web, cotton and knitted cotton. More particularly, the liquid retentive layers, 26 and 30, of the laminate 25 may be formed from a nonwoven, such as wettable SMS. In one embodiment, the liquid retentive layer 26 may form the outer layer of the cuff 20 and the liquid retentive layer 30 may form the inner layer of the cuff 20.

Figure 4:
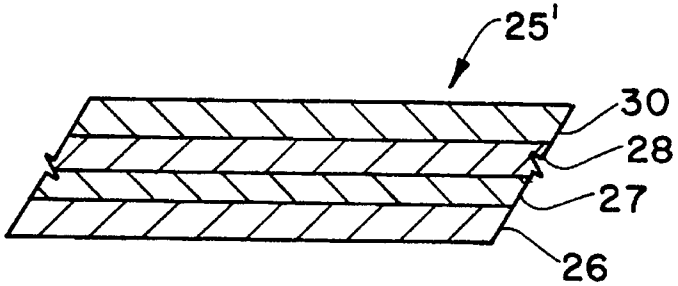
FIG. 4 is a schematic cross-sectional view of a portion of another elastic laminate embodiment useful in forming the cuff.

Referring now to FIG. 4, the laminate 25 may be formed into an elastic laminate 25' by securing a plurality of tensioned elastic yarns 27 between the liquid impervious layer 28 and the liquid retentive layer 26. It will be understood that the elastic yarns 27 may also be secured between the liquid impervious layer 28 and the liquid retentive layer 30.

The elastic yarns 27 may be formed from synthetic or natural materials. An example of a synthetic material for forming the elastic yarns 27 is polyurethane. Spandex is an example of polyurethane-based elastomer. More particularly, spandex is a polyurethane in fiber form containing a thermoplastic polyurethane elastomer with at least 85% polyurethane content. Commercial examples of spandex include LYCRA®, VYRENE®, DORLASTAN®, SPANZELLE® and GLOSPAN®. An example of a natural material for forming the elastic yarns 27 is natural rubber.

Figure 5:
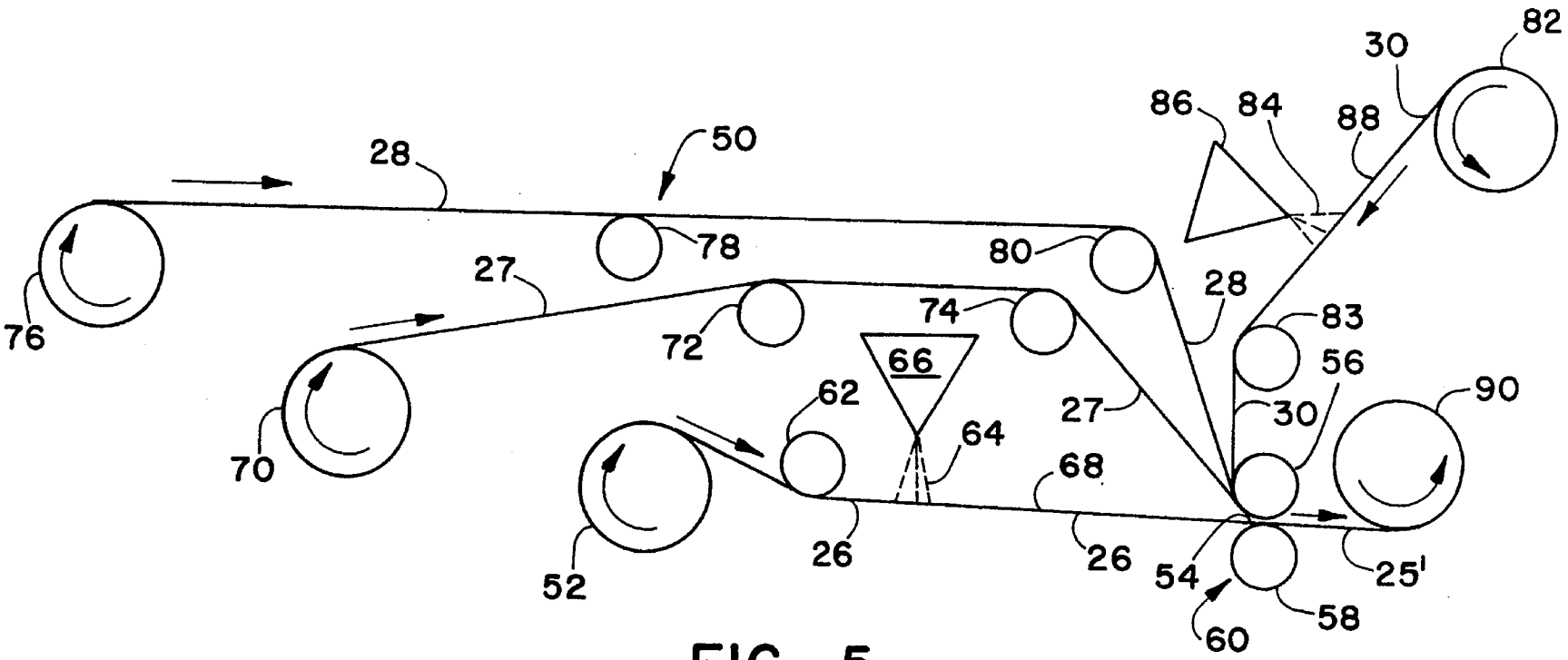
FIG. 5 is a schematic representation of an exemplary process for forming the elastic laminate illustrated in FIG. 4.

FIG. 5 schematically illustrates a process 50 for forming the elastic laminate 25'. The liquid retentive layer 26 is unwound from a supply roll 52 in the direction indicated by the arrow associated therewith as the supply roll 52 rotates in the direction of the arrow associated therewith. Between the pressure nip 54, formed by rollers 56 and 58 of the bonder roller arrangement 60, and the guide roller 62, an adhesive 64 (described above) exits an extruder 66 and is applied to a surface 68 of the liquid retentive layer 26.

The elastic yarns 27 are unwounded from a supply roll 70 in the direction indicated by the arrow associated therewith and the supply roll 70 rotated in the direction of the arrow associated therewith. Between the pressure nip 54 and the supply roll 70, the elastic yarns 27 are tensioned, by elongation, and are supported by guide rollers 72 and 74.

The liquid impervious layer 28 is unwound from a supply roll 76 in the direction indicated by the arrow associated therewith as the supply roll 76 rotates in the direction of the arrow associated therewith. Between the pressure nip 54 and the supply roll 76, the liquid impervious layer 28 is supported by guide rollers 78 and 80.

The liquid retentive layer 30 is unwound from a supply roll 82 in the direction indicated by the arrow associated therewith and the supply roll 82 rotates in the direction of the arrow associated therewith. Between a guide roller 83 and the supply roll 82, an adhesive 84 (described above) exits an extruder 86 and is applied to a surface 88 of the liquid retentive layer 30.

At the pressure nip 54, the tensioned elastic yarns 27 are captured between the liquid retentive layer 26 and the liquid impervious layer 28 and are secured together by the adhesive 64. Substantially simultaneously with the capture and securing of tensioned elastic yarns 27 between the liquid retentive layer 26 and liquid impervious layer 28, the liquid retentive layer 30 is secured to the liquid impervious layer 28 by the adhesive 84. Upon exiting the pressure nip 54, the elastic yarns 27 are permitted to relax such that gathers are formed in the elastic laminate 25'. Other methods for forming a gathers in an elastic laminate are disclosed in U.S. Pat. No. 4,720,415 which is herein incorporated by reference. The elastic laminate 25' is collected on a roll 90 which is rotating in the direction of the arrow associated therewith.

Figure 6:
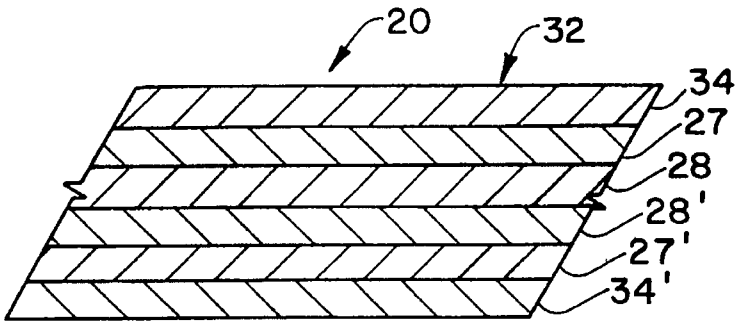
FIG. 6 is a schematic cross-sectional view of a portion of another elastic laminate embodiment used in forming the cuff.

In another embodiment, referring now to FIG. 6, the cuff 20 may be formed from a laminate 32 which includes a pair of juxtaposed liquid impervious layers, 28 and 28' captured between a pair of elastic yarn layers 27 and 27' which in turn are captured between a pair of liquid retentive layers, 34 and 34'. The liquid retentive layers 34 and 34' may be formed from any materials suitable for forming either of the liquid retentive layers, 26 or 30.

Figure 7:
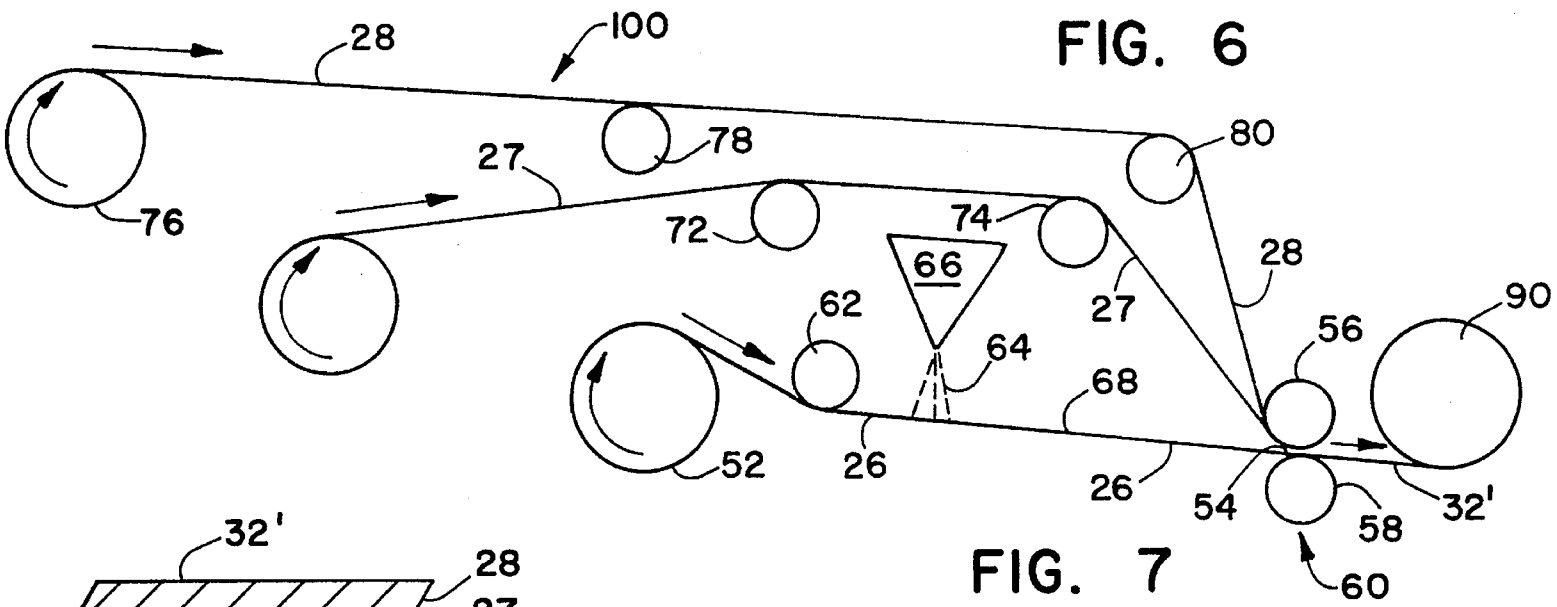
FIG. 7 is a schematic representation of an exemplary process for forming the elastic laminate illustrated in FIG. 6.
Figure 7A:
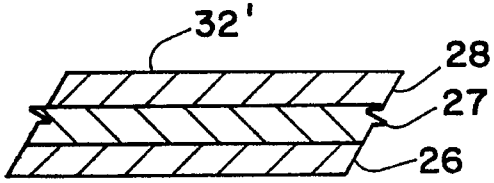

FIG. 7 schematically illustrates a process 100 for forming a laminate 32' which forms a portion of the laminate 32. This process is substantially similar to the process 50 except that the portion of the process 50 for supplying the liquid retentive layer 30 and applying the adhesive 84 thereto is absent from the process 100. As such, the laminate 32' collected on roll 90 is a three layered laminate, illustrated in FIG. 7A. The three layered laminate 32' may include the elastic yarns 27 captured between the liquid retentive layer 26 and the liquid impervious layer 28.

The laminate 32 is formed by folding the laminate 32' upon itself such that the liquid impervious layers 28 are juxtaposed. It will be noted that in FIG. 7, the liquid retentive layer 26 forms the liquid retentive layers 34 and 34', the elastic layer 27 forms the elastic layers 27 and 27' and the liquid impervious layer 28 forms the juxtaposed liquid impervious layers form layers, 28 and 28'. The folded configuration of the laminate 32 may be maintained by securing the juxtaposed liquid impervious layers, 28 and 28', together or by securing the edges (not shown) of the folded laminate 32 to each other or to the wrist opening 19 of the sleeve 18 (FIG. 1).

Figure 8:
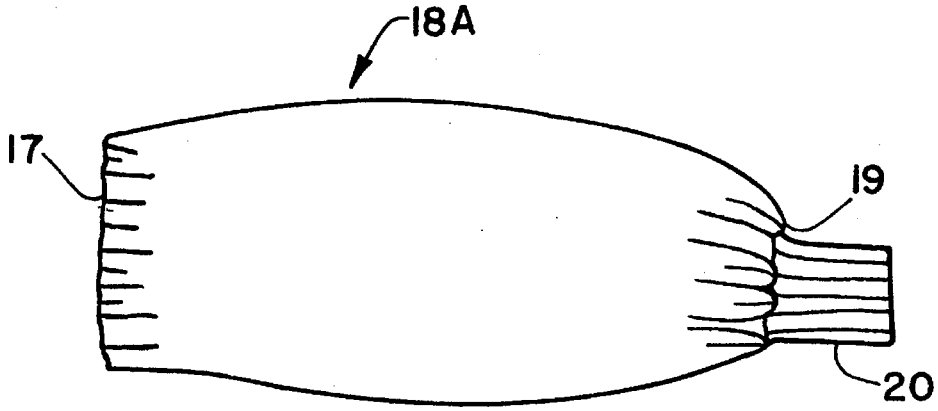
FIG. 8 is a plan view of a sleeve single.

Referring now to FIG. 8, a sleeve single 18A is illustrated. The sleeve single 18A is similar to the sleeve 18 except that the sleeve end 17 is not attached to the gown body 12. An elastic member (not shown), such as an elastic band, is secured to the sleeve end 17 of the sleeve single 18A so that the sleeve end 17 may frictionally engage a portion of the wearer's arm. In this way, the sleeve single 18A may be worn and removed without disturbing other garments worn by the wearer.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

What is claimed is:

1. A garment comprising:

a liquid impervious sleeve; and a cuff secured to the sleeve, wherein the cuff is formed from a sheetlike laminated material including an elastic layer captured between a liquid retentive layer and a liquid impervious layer.

2. The garment of claim 1 wherein the liquid retentive layer is a fabric selected from the group of polyester knit, bonded carded web, necked-bonded spunbond web, necked-stretched spunbond web, spunbond web, meltblown web, spunlaced web, rayon or cotton.

3. The garment of claim 1 wherein the cuff further includes another liquid retentive layer secured to the liquid impervious layer such that the liquid retentive layers are separated by the liquid impervious layer.

4. The garment of claim 1 wherein the liquid impervious layer is a film formed from materials selected from the group of polyethylene, polyurethane, ethylene vinylacetate, ethylene methacrylate and co-polyester.

5. The garment of claim 1 wherein the thickness of the liquid impervious layer is between about 0.5 mils to about 2.0 mils.

6. The garment of claim 1 wherein the liquid impervious sleeve includes a fibrous web secured to a liquid impervious film.

7. The garment of claim 6 wherein the liquid impervious film is formed from materials selected from the group of polyethylene, polyurethane, ethylene vinylacetate, ethylene methacrylate and co-polyester.

8. The garment of claim 1 wherein the elastic layer is formed from a plurality of elastic yarns.

9. The garment of claim 1 wherein the elastic layer is secured to the liquid retentive layer by a pressure sensitive hot-melt adhesive.

10. A surgical gown, comprising:

a sleeve and a cuff secured to the sleeve;

wherein the sleeve is formed from a fibrous web secured to a liquid impervious film; and wherein the cuff is formed from a sheetlike laminate material including an elastic layer captured between a liquid retentive layer and a liquid impervious layer.

11. The surgical gown of claim 10 wherein the cuff further includes another liquid retentive layer secured to the liquid impervious layer such that the liquid retentive layers are separated by the liquid impervious layer.

12. The surgical gown of claim 10 wherein the liquid retentive layer is a fabric selected from the group of polyester knit, bonded carded web, necked-bonded spunbond web, necked-stretched spunbond web, spunbond web, meltblown web, spunlaced web, rayon or cotton.

13. The surgical gown of claim 10 wherein the liquid impervious layer is a film formed from materials selected from the group of polyethylene, polyurethane, ethylene vinylacetate, ethylene methacrylate and co-polyester.

14. The surgical gown of claim 13 wherein the thickness of the liquid impervious layer is between about 0.5 mils to about 2.0 mils.

15. The surgical gown of claim 10 wherein the liquid impervious film is formed from materials selected from the group of polyethylene, polyurethane, ethylene vinylacetate, ethylene methacrylate and co-polyester.

16. The surgical gown of claim 10 wherein the elastic layer is formed from a plurality of elastic yarns.

17. A garment, comprising:

a liquid impervious sleeve; and a cuff secured to said sleeve, wherein said cuff is formed of an elastic layer captured between a first liquid retentive layer and a liquid impervious layer, and said cuff also including a second liquid retentive layer secured to said liquid impervious layer, such that said liquid retentive layers are separated by said liquid impervious layer.

18. The garment of claim 17, wherein the liquid retentive layer is a fabric selected from the group of polyester knit, bonded carded web, necked-bonded spunbound web, necked-stretched spunbound web, spunbound web, meltblown web, spunlaced web, rayon or cotton.

19. The garment of claim 17 wherein the liquid impervious layer is a film formed from materials selected from the group of polyethylene, polyurethane, ethylene vinylacetate, ethylene methacrylate and co-polyester.

20. The garment of claim 17, wherein the thickness of the liquid impervious layer is between about 0.5 mils to about 2.0 mils.

21. The garment of claim 17, wherein the liquid impervious sleeve includes a fibrous web secured to a liquid impervious film.

22. The garment of claim 17 wherein the elastic layer is secured to the liquid retentive layer by a pressure sensitive hot-melt adhesive.

23. A garment comprising:

a liquid impervious sleeve; and a cuff secured to said sleeve, wherein said cuff is formed from an elastic layer captured between a liquid retentive layer and a liquid impervious layer, and wherein said elastic layer is secured to said liquid retentive layer by a pressure sensitive hot-melt adhesive.

24. The garment of claim 23, wherein the liquid retentive layer is a fabric selected from the group of polyester knit, bonded carded web, necked-bonded spunbound web, necked-stretched spunbound web, spunbound web, meltblown web, spunlaced web, rayon or cotton.

25. The garment of claim 23 wherein the liquid impervious layer is a film formed from materials selected from the group of polyethylene, polyurethane, ethylene vinylacetate, ethylene methacrylate and co-polyester.

26. The garment of claim 23, wherein the thickness of the liquid impervious layer is between about 0.5 mils to about 2.0 mils.

27. The garment of claim 23, wherein the liquid impervious sleeve includes a fibrous web secured to a liquid impervious film.

28. A surgical gown comprising:

a sleeve and a cuff secured to said sleeve;

wherein said sleeve is formed from a fibrous web secured to a liquid impervious film; and wherein said cuff is formed from an elastic layer captured between a first liquid retentive layer and a liquid impervious layer, and a second liquid retentive layer secured to said liquid impervious layer such that said liquid retentive layers are separated by said liquid impervious layer.

* * * * *

UNITED STATES PATENT AND TRADEMARK OFFICE

CERTIFICATION OF CORRECTION

ATENT NO. : 5,594,955

ATED : January 21, 1997

VENTOR(S): Jay Richard Sommers

It is certified that error appears in the above-identified patent and that said Letters atent is hereby corrected as shown below:

Column 4, line 5, "poly(trichloroacetaidehyde)" should read poly(trichloroacetaldehyde)--.

Signed and Sealed this

Sixth Day of May, 1997

*Attest:*

*Attesting Officer*

BRUCE LEHMAN

*Commissioner of Patents and Trademarks*